US006033824A

United States Patent [19]

Hare et al.

[11] Patent Number: 6,033,824

[45] **Date of Patent: *Mar. 7, 2000**

[54] SILVER HALIDE PHOTOGRAPHIC MATERIAL AND METHOD OF APPLYING A PHOTOGRAPHIC IMAGE TO A RECEPTOR ELEMENT

[75] Inventors: Donald S. Hare, Hawley, Pa.; Scott A. Williams, Rochester, N.Y.

[73] Assignee: Foto-Wear, Inc., Milford, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,296

[22] Filed: Oct. 31, 1997

Related U.S. Application Data

[60] Provisional application No. 60/029,917, Nov. 4, 1996.

[51] Int. Cl.[7] ..... G03C 7/396; G03C 7/32; G03C 1/04; G03C 1/805

[52] U.S. Cl. ..... 430/263; 430/256; 430/259; 430/262; 430/627; 430/545

[58] Field of Search ..... 430/200, 256, 430/259, 262, 263, 138, 627, 254, 545, 255

[56] References Cited

U.S. PATENT DOCUMENTS

| | | | |
|---|---|---|---|
| 2,376,005 | 5/1945 | Potter et al. . | |
| 2,596,754 | 5/1952 | Yackel . | |
| 2,599,119 | 6/1952 | McQueen . | |
| 2,731,347 | 1/1956 | Gray . | |
| 3,253,926 | 5/1966 | Van Pee et al. . | |
| 3,476,937 | 11/1969 | Vrancken . | |
| 3,518,088 | 6/1970 | Dunn et al. . | |
| 3,556,795 | 1/1971 | Hughes . | |
| 3,649,271 | 3/1972 | Vrancken et al. . | |
| 3,650,740 | 3/1972 | Van Paesschen et al. . | |
| 3,748,143 | 7/1973 | Bowman . | |
| 3,832,183 | 8/1974 | Rogers et al. | 430/138 |
| 4,033,770 | 7/1977 | De Haes et al. | 430/248 |
| 4,201,404 | 5/1980 | Charbonneau et al. | 282/27.5 |
| 4,244,358 | 1/1981 | Pyers . | |
| 4,773,953 | 9/1988 | Hare . | |
| 4,808,565 | 2/1989 | Whitcomb et al. | 503/211 |
| 4,879,175 | 11/1989 | Ugro, Jr. | 428/321.5 |
| 5,064,744 | 11/1991 | Fukui et al. | 430/200 |

(List continued on next page.)

FOREIGN PATENT DOCUMENTS

| | | |
|---|---|---|
| 2285635A | 4/1976 | France . |
| 50-62700 | 5/1975 | Japan . |
| 50-108010 | 8/1975 | Japan . |
| 50-108011 | 8/1975 | Japan . |
| 63-137897 | 6/1988 | Japan . |
| 63-173054 | 7/1988 | Japan . |
| WO 91/03766 | 3/1991 | WIPO . |

*Primary Examiner*—Richard L. Schilling
*Attorney, Agent, or Firm*—Birch, Stewart, Kolasch & Birch, LLP

[57] ABSTRACT

The present invention relates to a silver halide photographic element, which comprises a support having a front and rear surface, and at least one silver halide light sensitive emulsion layer containing light sensitive silver halide grains on said front surface of the support, with the proviso that the silver halide grains are non-organic silver salts, and with the proviso that said emulsion layer does not contain a dye donating substance, wherein the silver halide grains are dispersed in or located on a carrier having a melting point of at least 100° C. and which is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of -said silver halide grains. The present invention further relates to a method of transferring a photographic image to a receptor element.

23 Claims, 1 Drawing Sheet

U.S. PATENT DOCUMENTS

| | | | |
|---|---|---|---|
| 5,242,739 | 9/1993 | Kronzer et al. | 428/200 |
| 5,242,781 | 9/1993 | Ohbayashi et al. | 430/203 |
| 5,366,837 | 11/1994 | Sakani | 430/138 |
| 5,482,815 | 1/1996 | Nakagawa et al. | 430/264 |
| 5,501,902 | 3/1996 | Kronzer . | |
| 5,545,505 | 8/1996 | Simpson | 430/264 |
| 5,558,983 | 9/1996 | Simpson et al. | 430/619 |
| 5,597,557 | 1/1997 | Kumar et al. | 106/401 |
| 5,620,548 | 4/1997 | Hare | 430/14 |
| 5,670,446 | 9/1997 | Jubran et al. | 503/201 |
| 5,846,901 | 12/1998 | Jubran | 503/201 |

SILVER HALIDE PHOTOGRAPHIC MATERIAL AND METHOD OF APPLYING A PHOTOGRAPHIC IMAGE TO A RECEPTOR ELEMENT

The contents of Provisional Application U.S. Ser. No. 60/029,917 filed on Nov. 4, 1996, on which the present application is based and benefit is claimed under 35 USC 119(e), is herein incorporated by reference.

BACKGROUND OF THE INVENTION

1. Field of the Invention

The present invention relates to a silver halide photographic transfer element, a method of applying a photographic image to a receptor element, and to a silver halide photographic element per se. More specifically, the present invention relates to photographic films or prints having images which are capable of being directly transferred to, for instance, a textile such as a shirt or the like without requiring the use of commercial equipment, such as video cameras, computers, color copiers, home and/or lithographic printers.

2. Description of the Prior Art

Textiles such as shirts (e.g., tee shirts) having a variety of designs thereon have become very popular in recent years. Many shirts are sold with pre-printed designs to suit the tastes of consumers. In addition, many customized tee shirt stores are now in business which permit customers to select designs or decals of their choice. Processes have also been proposed which permit customers to create their own designs on transfer sheets for application to tee shirts by use of a conventional iron, such as described in U.S. Pat. No. 4,244,358 issued Sep. 23, 1980. Furthermore, U.S. Pat. No. 4,773,953 issued Sep. 27, 1988, is directed to a method for utilizing a personal computer, a video camera or the like to create graphics, images, or creative designs on a fabric.

Therefore, in order to attract the interest of consumer groups which are already captivated by the tee shirt rage described above, the present inventor provides the capability of transferring photographic images directly to a receiver element using a material capable of holding and transferring an image. A unique advantage of the invention is to enable all consumers to wear and display on apparel their favorite moments captured on film and to do so in the single most cost and time efficient means.

Copending applications U.S. Ser. Nos. 08/206,218, now abandoned and 08/479,409, which are herein incorporated by reference, are directed to a silver halide photographic transfer element and to a method for transferring an image from the transfer element to a receptor surface. These copending applications differ from the claimed invention in that they require a separate transfer layer. In contrast, in the present invention, the silver halide light sensitive grains are dispersed within or are located on a carrier which functions as a transfer layer.

SUMMARY OF THE INVENTION

Accordingly, the present invention is directed to a conventional silver halide photographic element (e.g. wet processing), which comprises, a support having a front and rear surface, and at least one silver halide light sensitive emulsion layer containing light sensitive silver halide grains on said front surface of the support with the proviso that the silver halide grains are non-organic silver salts and with the proviso that said emulsion layer does not contain a dye donating substance, wherein the silver halide grains are dispersed in or located on a carrier which has a melting point of at least 100° C. and which is capable of transferring and adhering developed image and non-image areas from said front surface of said support upon the application of heat energy to the rear surface of the support, said carrier capable of stripping from said front surface of the support by liquefying and releasing from said support when heated, said liquefied carrier providing adherence to a receptor element by flowing onto said receptor element and solidifying thereon, said adherence does not require an external adhesive layer and occurs in an area at least coextensive with the area of said silver halide grains. Preferably, the particle size of the carrier is from 1–20 micrometers.

Although the carrier is capable of performing the transfer function described above, the carrier of the invention may be used in place of conventional carriers for photographic materials. Thus, the present invention is also applicable to photographic materials which are not necessarily intended for image transfer.

The silver halide photographic element of the invention is applicable to conventional photographic systems (e.g. wet processing) such as color paper (e.g. print and reversal), color negative film, color reversal film, black and white film or paper, or the like. Color diffusion film units (e.g. instant type prints) are included as a product per se of the present invention. However thermal developable microcapsule type systems are excluded if the only change is mixing the silver halide and the carrier of the invention in the same layer. However, all types of silver halide photographic elements containing the claimed carrier may be transferred in accordance with the process of the invention.

The receptor surface for the image may be a textile such as a shirt (e.g. tee shirt) or the like. Other suitable receptor surfaces include canvas, paper, glass, or receptor supports used by the museum or conservatory industry.

The present invention also relates to a method of applying a photographic image to a receptor element, which comprises the steps of:

(a) exposing imagewise a silver halide photographic element, which comprises, a support having a front and rear surface, and at least one silver halide light sensitive emulsion layer containing light sensitive silver halide grains on said front surface of the support, wherein the silver halide grains are dispersed in or located on a carrier which is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external adhesive layer and occurs in an area at least coextensive with the area of said silver halide grains, (b) developing the imagewise exposed silver halide light sensitive photographic element to form a photographic image, (c) positioning the front surface of said silver halide photographic element against said receptor element, and (d) applying energy (e.g. heat) to the rear surface of the silver halide photographic element to transfer said photographic image to said receptor element.

The receptor element may be textile, leather, ceramic, wool, glass or plastic. Preferably, the receptor element is a shirt or the like. Energy applied to the rear surface of the silver halide photographic element is heat and/or pressure (e.g. via ironing).

The carrier for the silver halide photographic element is generally capable of performing the same function as conventional carriers, such as providing means for providing a vehicle for carrying the light sensitive silver halide grains and associated chemicals (e.g. color couplers). However, the carrier of the invention should preferably be capable of transferring and adhering developed image and non-image areas from the front surface of the support upon the application of heat energy to the rear surface of the support. The carrier strips from said front surface of the support by liquefying and releasing from the support when heated. The liquefied carrier provides adherence to a receptor element by flowing onto the receptor element and solidifying thereon. The adherence does not require an external adhesive layer and occurs in an area at least coextensive with the area of the silver halide grains.

BRIEF DESCRIPTION OF THE DRAWINGS

The present invention will become more fully understood from the detailed description given hereinbelow, and the accompanying drawings which are given by way of illustration only, and thus are not limitative of the present invention, and wherein:

FIG. 2 illustrates the step of ironing the silver halide photographic transfer element onto a tee shirt or the like.

DETAILED DESCRIPTION OF THE INVENTION

Figure 1:
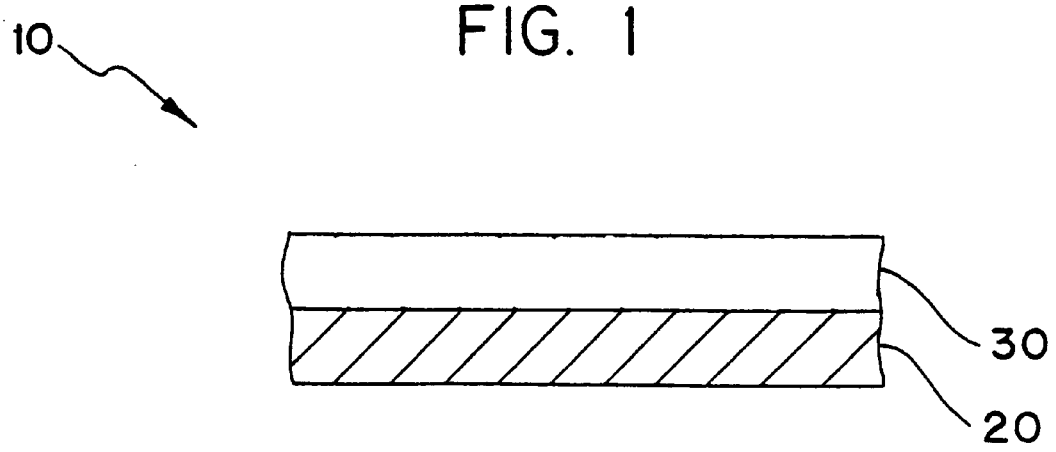
FIG. 1 is a cross-sectional view of the preferred embodiment of the silver halide photographic transfer element of the present invention.

Photographic emulsions require a suitable transparent vehicle that permits coating and subsequent drying to form a generally flexible layer. Conventional carriers, such as gelatin, provide a medium for crystallization of silver halide grains, that is, provides the ability to control crystal growth and maintain suspension. Conventional carriers (e.g. gelatin) are generally crosslinkable for strength and are capable of swelling in order to facilitate chemical processing.

A preferred carrier for photographic systems is inexpensive, easy to handle, and acts only as a binding agent. Thus, it is preferred that the carrier in photographic systems be inert. Further, it is generally necessary to harden a conventional gelatin carrier to toughen the layer and to make it more resistant to abrasion.

The carrier of the invention also functions as a binder. However, unlike conventional carriers (e.g. gelatin), it is unnecessary for the carrier to swell when it contains sufficient porosity, in order to allow the chemical processing solutions to pass therethrough and develop the latent image. Thus, the carrier of the invention may function as a binder without the requirement of swelling of conventional carriers when it contains suitable porosity.

A further requirement of a suitable carrier when it is used in a transfer element is that it adhere strongly to fibrous supports, and optionally to glassy supports.

Moreover, when the carrier is used in a transfer element, it is not necessary that it be as "inert" as conventional carriers. For instance, conventional carriers should not adversely affect image stability in either the dark or light over a period of decades. However, since the life of a transfer product (e.g. image transferred to a tee shirt) is measured in months or years rather than decades, adverse affect on image stability is not considered problematic. This expected short life of the ultimate product allows for the selection of less expensive materials. Further, other photographic properties may be similarly reoptimized, if necessary, in view of the expected short life of the product.

The carrier of the invention must also be capable of transfer from the photographic support and adherence to a receptor support without the requirement of a separate surface adhesive layer. Without being bound by any theory, upon back surface heating of the support, the carrier of the silver halide layer would undergo a solid to solution phase transition resulting in a transfer to the receiving layer. Edge to edge adhesion, to the receiving layer, would occur upon cooling of the carrier onto the receiving layer. Upon cooling, an image layer would be completely transferred onto the receiving layer with an excess of carrier providing mechanical and thermal stability, as well as washability.

The carrier should provide a colorfast image when transferred to the receptor surface. That is, upon washing the receptor element (e.g. tee shirt), the image should remain intact on the receptor element.

The carrier of the present invention may also be used in place of conventional carriers, such as gelatin, in photographic materials. However, since the carrier of the invention is also capable of transfer from the photographic support to a receptor support, it is suitable for use in a transfer product for transferring a photographic image to a receptor element.

In summary, the carrier of the invention has the following features not present in conventionally known carriers:

(1) The carrier of the invention functions as a binder without the requirement of swelling when it contains sufficient porosity to allow the photographic developing chemicals to pass therethrough.

(2) The carrier, when it is used in a transfer element, should adhere strongly to fibrous supports, and optionally to glassy supports.

(3) When the carrier is used in a transfer element, it is not necessary that it be as "inert" or as pure as conventional carriers, in view of the expected relatively short shelf-life of the product. Where the product is to be used for archival reasons (e.g. museum) the carrier which is selected must be inert so as to not adversely affect image stability.

(4) The carrier must also be capable of transfer from the photographic support and adherence to a receptor support without the requirement of a separate surface adhesive layer.

(5) The carrier should provide a colorfast image when transferred to the receptor surface.

Suitable carriers of the invention are exemplified below. However, it is easy to screen for suitable carriers without undue experimentation in view of the performance criteria discussed in this application. For instance, see the Examples discussed below for suitable screening protocol. Further, the carriers of the invention may be mixed with conventional carriers (e.g. gelatin) so long as the amount of conventional carrier does not adversely affect the transfer properties of the carrier. In one embodiment of the invention, the maximum amount of gelatin in the mixture is about 30 g/l solvent (e.g. 3 wt %).

Representative embodiments of the present invention include a silver halide photographic element wherein the photographic layer(s) containing the silver halide grains contain conventional gelatin, and each interlayer (filter layers) will comprise the carrier of the invention. Alternatively, all layers contain the new carrier formulation and no gelatin is contained in the photographic element. Further, as in Example 3, the layers of the photographic element may contain a mixture of conventional carrier (e.g. gelatin) and the carrier of the invention. If used as a transfer element, the amount of gelatin present should not adversely affect the transfer and adhesion properties of the carrier.

Suitable carrier materials include the compositions from U.S. Pat. Nos. 5,501,902, 5,271,990 and 5,242,739. The contents of U.S. Pat. Nos. 5,501,902, 5,271,990 and 5,242,739 are herein incorporated by reference. These patents are discussed in turn hereinbelow.

The carrier of the present invention utilizes the materials of the second layer of U.S. Pat. No. 5,501,902.

The carrier preferably includes particles of a thermoplastic polymer having dimensions of from about 1 to about 20 micrometers. The particles will more preferably have dimensions of from about 2 to about 10 micrometers. In general, the thermoplastic polymer can be any thermoplastic polymer which meets the criteria set forth herein. Desirably, the powdered thermoplastic polymer will be selected from the group consisting of polyolefins, polyesters, and ethylene-vinyl acetate copolymers.

The carrier also includes from about 10 to about 50 weight percent of a film-forming binder, based on the weight of the thermoplastic polymer. Desirably, the amount of binder will be from about 10 to about 30 weight percent. In general, any film-forming binder may be employed which meets the criteria set forth herein. When the second layer includes a cationic polymer, a nonionic or cationic dispersion or solution may be employed as the binder. Suitable binders include polyacrylates, polyethylenes, and ethylenevinyl acetate copolymers. The latter are particularly desired because of their stability in the presence of cationic polymers. The binder desirably will be heat softenable at temperatures of about 120° Celsius or lower.

The basis weight of the carrier layer may vary as desired, but preferably the carrier is cumulatively present amongst all the layers in an amount from about 5 to about 30 $g/m^2$. Desirably, the basis weight will be from about 10 to about 20 $g/m^2$. The carrier layer(s) can be applied to the support, either directly or over another layer, by means well known to those having ordinary skill in the art. For example, the layer may be applied by curtain coating, Meyer rod, air knife, and gravure coating, by way of illustration only.

When the photographic material is intended to be used as a heat-transfer material, the carrier will have a melting point of from about 65 to about 180 degrees Celsius. The term "melts" and variations thereof are used herein only in a qualitative sense and are not meant to refer to any particular test procedure. Reference herein to a melting temperature or range is meant only to indicate an approximate temperature or range at which a polymer or binder melts and flows under the conditions of a melt-transfer process to result in a substantially smooth film.

Manufacturers' published data regarding the melt behavior of polymers or binders correlate with the melting requirements described herein. It should be noted, however, that either a true melting point or a softening point may be given, depending on the nature of the material. For example, materials such a polyolefins and waxes, being composed mainly of linear polymeric molecules, generally melt over a relatively narrow temperature range since they are somewhat crystalline below the melting point.

Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined by ASTM E-28, is useful in predicting their behavior. Moreover, the melting points or softening points described are better indicators of performance than the chemical nature of the polymer or binder.

When the material is intended to be used as a heat-transfer material, the carrier desirably also will contain from about 2 to about 20 weight percent of a cationic polymer, based on the weight of the thermoplastic polymer. The cationic polymer may be, for example, an amide-epichlorohydrin polymer, polyacrylamides with cationic functional groups, polyethyleneimines, polydiallylamines, and the like. When a cationic polymer is present, a compatible binder should be selected. The binder desirably will be a nonionic binder, either in the form of a solution or a nonionic or cationic dispersion or emulsion. As is well known in the paper coating art, many commercially available binders have anionically charged particles or polymer molecules. These materials are generally not compatible with the cationic polymer which may be used in the present invention.

One or more other components may be used in the carrier. For example, the carrier may contain from about 1 to about 20 weight percent of a humectant, based on the weight of the thermoplastic polymer. Desirably, the humectant will be selected from the group consisting of ethylene glycol and poly(ethylene glycol). The poly(ethylene glycol) typically will have a weight average molecular weight of from about 100 to about 40,000. A poly(ethylene glycol) having a weight-average molecular weight of from about 200 to about 800 is particularly useful.

The carrier also may contain from about 0.2 to about 10 weight percent of a fluid (e.g. ink) viscosity modifier, based on the weight of the thermoplastic polymer. The viscosity modifier desirably will be a poly(ethylene glycol) having a weight-average molecular weight of from about 100,000 to about 2,000,000. The poly(ethylene glycol) desirably will have a weight-average molecular weight of from about 100,000 to about 600,000.

Other components which may be present in the carrier layer include from about 0.1 to about 5 weight percent of a weak acid and from about 0.5 to about 5 weight percent of a surfactant, both based on the weight of the thermoplastic polymer. A particularly useful weak acid is citric acid. The term "weak acid" is used herein to mean an acid having a dissociation constant less than one (or a negative log of the dissociation constant greater than 1).

The surfactant may be an anionic, a nonionic, or a cationic surfactant. When a cationic polymer is present in the carrier, the surfactant should not be an anionic surfactant.

Desirably, the surfactant will be a nonionic or cationic surfactant. However, in the absence of the cationic polymer, an anionic surfactant may be used, if desired. Examples of anionic surfactants include, among others, linear and branched-chain sodium alkylbenzenesulfonates, linear and branched-chain alkyl sulfates, and linear and branched-chain alkyl ethoxy sulfates. Cationic surfactant include, by way of illustration, tallow trimethylammonium chloride. Examples of nonionic surfactants, include, again by way of illustration only, alkyl polyethoxylates, polyethoxylated alkylphenols, fatty acid ethanol amides, complex polymers of ethylene oxide, propylene oxide, and alcohols, and polysiloxane polyethers. More desirably, the surfactant will be a nonionic surfactant.

For heat transfer applications, the photographic material of the invention may optionally have a melt-transfer layer located above the support and below the silver halide photographic layer(s) and/or interlayer or subbing layers. Such a melt-transfer film layer typically comprises a film forming binder, as already described, or other polymer. The layer desirably is applied by extrusion coating, but other methods also may be used. The melt-transfer film layer desirably is formed from a polyethylene or a copolymer of ethylene with acrylic acid, methacrylic acid, vinyl acetate, or acrylic acid esters such as ethyl acrylate. The polymer desirably will have a melt flow rate of at least about 30 grams per 10 minutes (g/10 minutes), as determined in accordance with ASTM Method D-1238, although the melt flow rate may be as high as about 4,000 g/10 minutes. More desirably, the melt flow rate of the polymer will be from about 300 to about 700 g/10 minutes. The basis weight of the melt-transfer film layer desirably will be from about 10 to about 50 grams per square meter ($g/m^2$), with a basis weight of from about 30 to about 50 being more desired.

A release layer may be included, either in place of or in addition to the melt-transfer film layer. In the former instance, the release layer will be placed above the support and below the photographic layer(s) and/or interlayers or subbing layers. In the latter instance, the release layer will be placed between the support and the melt-transfer film layer. The release layer desirably will be a low molecular weight ethylene-acrylic acid copolymer applied from an aqueous dispersion. The melt flow rate of the ethylene-acrylic acid copolymer desirably will be at least about 200 g/10 minutes, more desirably from about 800 to about 1,200 g/10 minutes. Such dispersion also may contain a paraffin wax, which is mixed as an emulsion with the ethylene-acrylic acid copolymer dispersion. The paraffin wax emulsion can be any of those which are commercially available, such as Chemwax ®40 (Chematron, Inc., Charlotte, N.C.). The ratio of paraffin wax to the copolymer may vary from 0 to about 4, with a ratio of about 1 being more desirable. The basis weight of the release layer desirably will be from about 2 to about 20 $g/m^2$, more desirably from about 6 to about 10 $g/m^2$. The release coating as described melts easily and provides easy release from the first layer for hand ironing of images onto a fabric; such characteristic is especially useful if heating of the image is irregular, which is not atypical of hand-ironing techniques.

The various layers of the photographic material are formed by known coating techniques, such as by roll, blade, curtain coating and air-knife coating procedures. The resulting material, then is dried by means of, for example, steam-heated drums, air impingement, radiant heating, or some combination thereof. Some care must be exercised, however, to assure that drying temperatures are sufficiently low so that the particles of thermoplastic polymer present in the carrier layer do not melt during the drying process (e.g. air impingement for 5 minutes or more at 80° Celsius).

Heat transfer of an image in the photographic material of the present invention may be by any known means, such as by a hand-held iron or a heat-transfer press. The transfer temperature typically will be from about 120° to about 205° Celsius, for from about 5 seconds to about 2 minutes.

Accordingly, the carrier of the invention may comprise particles of a thermoplastic polymer preferably having dimensions of from about 1 to about 20 micrometers, and more preferably from about 2 to about 10 micrometers, from about 10 to about 50 weight percent of a film-forming binder, based on the weight of the thermoplastic polymer, and from about 0.2 to about 10 weight percent of a viscosity modifier, based on the weight of the thermoplastic polymer.

The carrier preferably has a melting point of more than 100° C. and more preferably from about 100 to about 180 degrees Celsius. The carrier may also contain from about 2 to about 20 weight percent of a cationic polymer, based on the weight of the thermoplastic polymer. The carrier may also contain from about 1 to about 20 weight percent of a humectant, based on the weight of the thermoplastic polymer. The humectant may be (1) ethylene glycol or (2) polyethylene glycol (e.g. having a weight-average molecular weight of from about 100 to about 40,000, preferably about 200 to about 800).

The viscosity modifier may be a polyethylene glycol having a weight average molecular weight of from 100,000 to about 2,000,000, preferably from about 100,000 to about 600,000. The viscosity modifier may be low or high viscosity methyl cellulose or polyvinyl alcohol.

The carrier may also include about 0.1 to about 5 weight percent of a weak acid, based on the weight of the thermoplastic polymer. The carrier may also include about 0.5 to about 5 weight percent of a surfactant (e.g. nonionic or cationic), based on the weight of the thermoplastic polymer.

A release layer is optionally interposed between the support and the photographic layers containing carrier of the invention.

The carrier preferably melts above 100° C., more preferably, from about 100 to about 180 degrees Celsius and may comprise particles of a thermoplastic polymer having dimensions of about 1 to about 20 micrometers, more preferably from about 2 to about 10 micrometers, from about 10 to about 50 weight percent of a film-forming binder, based on the thermoplastic polymer, and from about 2 to about 20 weight percent of a cationic polymer, based on the weight of the thermoplastic polymer.

The carrier may further comprise from about 1 to about 20 weight percent of a humectant, based on the weight of the thermoplastic polymer (and optionally from about 0.2 to about 10 weight percent of a fluid (e.g. ink) viscosity modifier, based on the weight of the thermoplastic polymer), and from 0.5 to about 5 weight percent of a surfactant, based on the weight of the thermoplastic polymer.

The carrier of the present invention also utilizes the materials of the image receptive melt-transfer film layer of U.S. Pat. No. 5,271,990.

The carrier may be comprised of a thermoplastic polymer which melts at above 100° C., and preferably in the range of from about 100 to about 180 degrees Celsius (°C.). In another embodiment, the thermoplastic polymer melts in the range of from about 100° C. to about 120° C.

The nature of the thermoplastic polymer (e.g. carrier) is not known to be critical, but generally it should be photographically inert (e.g. not adversely affecting the properties relating to the photographic image). That is, any known thermoplastic polymer can employed so long as it meets the criteria specified herein. Preferably, the thermoplastic polymer is selected from the group consisting of polyolefins, polyesters, and ethylene-vinyl acetate copolymers, preferably having a particle size of less than 20 and more preferably less than 10 micrometers.

If desired, as already noted, the photographic material containing the carrier of the invention may optionally have a melt-transfer film layer. In this instance, the melt-transfer film layer overlays the top surface of the base sheet and the photographic layers including interlayer(s) overlays the melt transfer film layer.

In general, the melt-transfer film layer is comprised of a first thermoplastic polymer and the photographic layers including interlayers are comprised of a second thermoplastic polymer, each of which melts above 100° C., and preferably in the range of from about 100° C. to about 180° C. Preferably, the first thermoplastic polymer is selected from the group consisting of polyolefins, polyesters, ethylene-vinyl acetate copolymers, ethylene-methacrylic acid copolymers, and ethylene-acrylic acid copolymers. In addition, the second thermoplastic polymer preferably is selected from the group consisting of polyolefins, polyesters, and ethylene-vinyl acetate copolymers.

The term "melts" and variations thereof are used herein only in a qualitative sense and are not meant to refer to any particular test procedure. Reference herein to a melting temperature or range is meant only to indicate an approximate temperature or range at which a thermoplastic polymer melts and flows under film forming conditions to result in a substantially smooth film.

The carrier may comprise a thermoplastic polymer selected from the group consisting of polyolefins, polyesters, and ethylene-vinyl acetate copolymers and which melts above 100° C., and preferably in the range of from about 100 to about 180 degrees Celsius, and preferably in the range of about 100 to about 120 degrees Celsius.

An example of the carrier of the invention is Elvax 3200 supplied by E.I. Du Pont de Nemours & Company, Inc., Polymer Products Department, Ethylene Polymers Division, Wilmington, Del. Elvax 3200 is an ethylene-vinyl acetate copolymer containing approximately 25% vinyl acetate and modified with wax. It has a melt index of 32 g/10 minutes. Another carrier of the invention is Surlyn 1702 also supplied by DuPont. Surlyn 1702 is an ionomer consisting of a cross-linked ethylene-methacrylic acid copolymer having a melt index of 14 g/10 minutes. These carriers may be utilized separately or together.

The carrier of the present invention also utilizes the materials of the image-receptive melt-transfer film layer of U.S. Pat. No. 5,242,739.

The carrier may comprise from about 15 to about 80 percent by weight of a film-forming binder selected from the group consisting of ethylene-acrylic acid copolymers, polyolefins, and waxes and from about 85 to about 20 percent by weight of a powdered thermoplastic polymer selected from the group consisting of polyolefins, polyesters, polyamides, waxes, epoxy polymers, ethylene-acrylic acid copolymers, and ethylene-vinyl acetate copolymers, wherein each of said film-forming binder and said powdered thermoplastic polymer melts about 100° C., preferably in the range of from about 100 to about 180 degrees Celsius and said powdered thermoplastic is preferably of particles which are from about 1 to about 20 micrometers in diameter.

Thus, the carrier comprises from about 15 to about 80 percent by weight of a film-forming binder and from about 85 to about 20 percent by weight of a powdered thermoplastic polymer. Each of the film-forming binder and powdered thermoplastic polymer melts above 100° C., preferably in the range of from about 100 to about 180 degrees Celsius (°C.). In addition, the powdered thermoplastic polymer is preferably composed of particles having diameters of from about 1 to about 20 micrometers.

In other embodiments, each of the film-forming binder and powdered thermoplastic polymer melt above 100° C., preferably in the range of from about 100° C. to about 120° C.

The function of the powdered thermoplastic polymer is to assist in the transferring of an image to a fabric, both in terms of ease of transfer and the permanence of the transferred image.

The nature of the film-forming binder is not known to be critical. That is, any film-forming binder can be employed so long as it meets the criteria specified herein. In preferred embodiments, the film-forming binder has, at the transfer temperature, a lower melt viscosity than the powdered thermoplastic polymer. As a practical matter, water-dispersible ethylene-acrylic acid copolymers have been found to be especially effective film forming binders.

In general, the powdered thermoplastic polymer can be any thermoplastic polymer which meets the criteria set forth herein. Preferably, the powdered thermoplastic polymer is selected from the group consisting of polyolefins, polyesters, and ethylene-vinyl acetate copolymers.

The powdered thermoplastic polymer flow partially into the fiber matrix of the fabric to which an image is being transferred. The result is a fabric having an image which does not render the fabric stiff. Moreover, the image itself is neither rubbery nor rough to the feel and is stable to repeated washings.

If desired, as already noted, the photographic material containing the carrier of the invention may optionally have a melt-transfer film layer. In this instance, the melt-transfer film layer overlays the top surface of the base sheet and the photographic layers including interlayers overlays the melt-transfer film layer.

The melt-transfer film layer comprises a film-forming binder as already described. The image-receptive film layer preferably comprises from about 15 to about 80 percent by weight of a film-forming binder (e.g. ethylene-acrylic acid copolymers; polyolefins and waxes which melt in the range of about 65 to about 180 degrees Celsius). The melt transfer layer may also contain from about 85 to about 20 percent by weight of a powdered thermoplastic polymer, each of which are as already defined.

As a general rule, the amount of powdered thermoplastic polymer employed can be reduced if larger particle sizes are employed. However, it is believed that the smaller the thermoplastic bead, the better, particularly if silver halide grains are grown in the presence of beads. Particle sizes are preferably from 1–20 micrometers and more preferable 2–10 micrometers.

If desired, any of the foregoing film layers can contain other materials, such as processing aids, release agents, pigments, deglossing agents, antifoam agents, and the like. The use of these and other like materials is well known to those having ordinary skill in the art.

Representative binders and powdered thermoplastic polymers are as follows:

Binder A

Binder A is Michem® 58035, supplied by Michelman, Inc., Cincinnati, Ohio. This is a 35 percent solids dispersion of Allied Chemical's AC 580, which is approximately 10 percent acrylic acid and 90 percent ethylene. The polymer reportedly has a softening point of 102° C. and a Brookfield viscosity of 0.65 pa s (650 centipoise) at 140° C.

Binder B

This binder is Michem® Prime 4983 (Michelman, Inc., Cincinnati, Ohio). The binder is a 25 percent solids dispersion of Primacor® 5983 made by Dow Chemical Company. The polymer contains 20 percent acrylic acid and 80 percent ethylene. The copolymer has a Vicat softening point of 43° C. and a ring and ball softening point of 100° C. The melt index of the copolymer is 500 g/10 minutes (determined in accordance with ASTM D-1238).

Binder C

Binder C is Michem® 4990 (Michelman, Inc., Cincinnati, Ohio). The material is 35 percent solids dispersion of Primacor® 5990 made by Dow Chemical Company. Primacor® 5990 is a copolymer of 20 percent acrylic acid and 80 percent ethylene. It is similar to Primacor® 5983 (see Binder B), except that the ring and ball softening point is 93° C. The copolymer has a melt index of 1,300 g/10 minutes and Vicat softening point of 39° C.

Binder D

This binder is Michem® 37140, a 40 percent solids dispersion of a Hoechst-Celanese high density polyethylene. The polymer is reported to have a melting point of 100° C.

Binder E

This binder is Michem® 32535 which is an emulsion of Allied Chemical Company's AC-325, a high density polyethylene. The melting point of the polymer is about 138° C. Michem® 32535 is supplied by Michelman, Inc., Cincinnati, Ohio.

Binder F

Binder F is Michem® 48040, an emulsion of an Eastman Chemical Company microcrystalline wax having a melting point of 88° C. The supplier is Michelman, Inc., Cincinnati, Ohio.

Powdered Thermoplastic Polymer A

This powdered polymer is Microthene® FE 532, an ethylenevinyl acetate copolymer supplied by Quantum Industries, Cincinnati, Ohio. The particle size is reported to be 20 micrometers. The vicat softening point is 75° C. and the melt index is 9 g/10 minutes.

Powdered Thermoplastic Polymer B

Powdered Thermoplastic Polymer B is Aqua Polysilk 19. It is a micronized polyethylene wax containing some polytetrafluoroethylene. The average particle size is 18 micrometers and the melting point of the polymer is 102°–118° C. The material is supplied by Micro Powders, Inc., Scarsdale, N.Y.

Powdered Thermoplastic Polymer C

This material is Microthene® FN-500, a polyethylene powder supplied by USI Chemicals Co., Cincinnati, Ohio. The material has a particle size of 20 micrometers, a Vicat softening point of 83° C., and a melt index of 22 g/10 minutes.

Powdered Thermoplastic Polymer D

This polymer is Aquawax 114, supplied by Micro Powders, Inc., Scarsdale, N.Y. The polymer has a reported melting point of 91°–93° C. and an average particle size of 3.5 micrometers; the maximum particle size is stated to be 13 micrometers.

Powdered Thermoplastic Polymer E

Powdered Thermoplastic Polymer E is Corvel® 23-9030, a clear polyester from the Powder Coatings Group of the Morton Chemical Division, Morton Thiokol, Inc., Reading, Pa.

Powdered Thermoplastic Polymer F

This material is Corvel® natural nylon 20-9001, also supplied by Morton Thiokol, Inc.

Powdered Thermoplastic Polymer G

This polymer powder is Corvel® clear epoxy 13-9020, supplied by Morton Thiokol, Inc.

Powdered Thermoplastic Polymer H

Powdered Thermoplastic Polymer H is AClyn® 246A, which has a melting temperature of about 95° C. as determined by differential scanning calorimetry. The polymer is an ethylene-acrylic acid magnesium ionomer. The material is supplied by Allied-Signal, Inc., Morristown, N.J.

Powdered Thermoplastic Polymer I

This polymer is AC-316A, an oxidized high density polyethylene. The material is supplied by Allied Chemical Company, Morristown, N.J.

Powdered Thermoplastic Polymer J

This polymer is Texture 5380, supplied by Shamrock Technologies, Inc., Newark, N.J. It is powdered polypropylene having a melting point of 165° C. and an average particle size of 40 micrometers.

The binders and thermoplastic polymers may be combined and blended as desired. For example, Binder A (e.g. 80 parts) may be blended with powdered thermoplastic polymer A (e.g. 80 parts) and optionally with a fluorocarbon dispersion such as Zonyl 7040 (e.g. 0.20 parts) obtained from duPont. Another example includes combining Binder B (e.g. 400 parts) and Polymer B (e.g. 70 parts) and blending in a standard laboratory colloid mill. Also, Binder A (e.g. 286 parts) may be combined with Polymer C (e.g. 65 parts). Binder B (e.g. 400 parts) may be combined with Polymer D (e.g. 70 parts). Binder C (e.g. 200 parts) may be combined with Polymer E (e.g. 35 parts) and optionally with propylene glycol (e.g. 20 parts) and water (e.g. 20 parts). Similarly, Binder C (e.g. 200 parts) may be combined with Polymer F (e.g. 54 parts) and optionally with propylene glycol (e.g. 20 parts) and water (e.g. 20 parts). Also, Binder A (e.g. 200 parts) may be combined with Polymer G (e.g. 30 parts) and optionally with propylene glycol (e.g. 20 parts) and water (e.g. 20 parts). Binder D (e.g. 200 parts) may be combined with Polymer H (e.g. 30 parts) and optionally water (e.g. 40 parts) and blended. Binder A (e.g. 286 parts) may be combined with Polymer J (e.g. 40 parts) and optionally with propylene glycol (e.g. 50 parts).

In another embodiment of the invention, the photographic layer or layers closest to the support may contain the carrier of the invention, whereas the uppermost layer or layers may contain conventional carrier(s), or a mixture of the carrier of the invention and conventional carrier. In this way, the bottom-most layer(s) serves as the transfer layer, without the need of an additional transfer layer.

Referring to FIG. 1, there is generally illustrated a cross-sectional view of the silver halide photographic transfer element 10 of the present invention. The transfer element 10 comprises a suitable support or substrate 20 which may be any type of material ordinarily used as a support for photographic materials. Examples thereof include cellulose acetate films, cellulose acetate propionate films, cellulose nitrate films, cellulose acetate butyrate films, polyethylene terephthalate films, polystyrene films, polycarbonate films, and laminated sheets of these films and papers. Suitable papers include papers coated with a polymer of an alpha olefin and preferably an alpha olefin having 2 to 10 carbon atoms, such as polyethylene, polypropylene, etc., and baryta coated papers, etc. The only limitation on the support is that it must separate from the carrier material 30 upon application of heat. If conventional polyolefin paper interferes with transfer due to poor separation from the carrier material, fiber based paper which does not contain a resin coated layer nearest the support layer or on both surfaces is preferably used.

The photographic layer(s) containing the carrier of the invention may be optionally coated on known transfer papers such as a transfer paper manufactured by Kimberly-Clark Corporation under the trademark "TRANSEEZE".

A photographic support or substrate may be coated with the desired photographic emulsions in a conventional manner by methods known to one of ordinary skill in the art. The carrier of the present invention may simply be substituted for conventional carrier(s), or mixed with conventional carrier(s), or may replace the conventional carrier in the bottom-most layer(s) in contact with the support. In the latter embodiment, the number of bottom-most layers which should be replaced is easily determined by first replacing the bottom-most layer and then optionally subsequent layers in order to ensure adequate transfer and adhesion. In another embodiment, only the non-silver halide containing layers contain the carrier of the invention, and the silver halide containing layers contain conventional carrier (e.g. gelatin) or a mixture of gelatin and carrier of the invention.

One preferred application of this invention is directed to photographic transfer elements capable of producing multicolor dye images. Such a photographic transfer element comprises a support and a plurality of color forming layers coated thereon. The color forming layers include at least one blue recording yellow dye image forming layer, at least one green recording magenta dye image forming layer, and at least one red recording cyan dye image forming layer. Interlayers may be positioned between the color forming layers. Each image forming layer includes at least one silver halide emulsion layer. A dye image providing material can be located in the emulsion layer, in an adjacent layer, or introduced during development. The blue sensitive emulsion layers can rely on native sensitivity to blue light or contain a blue sensitizing dye adsorbed to the silver halide grains of the blue sensitive layers. Spectral sensitizing dyes capable of absorbing green and red light are adsorbed to silver halide grain surfaces in the emulsions of the green and red recording color forming layers, respectively.

To prevent color contamination of adjacent color layers, oxidized development product scavengers including an oxidized developing agent and oxidized electron transfer agents can be incorporated at any location in the color forming layers or in an interlayer separating adjacent color forming layers. Suitable scavengers include alkyl substituted aminophenols and hydroquinones as disclosed in U.S. Pat. Nos. 2,336,327 and 2,937,086, sulfoalkyl substituted hydroquinones as disclosed in U.S. Pat. No. 2,701,197, and sulfonamido substituted phenols as disclosed in U.S. Pat. No. 4,205,987.

The order of the photographic layers on the support is any order conventional in the art. For example, in color print paper, the order of layers starting from the support is a blue sensitive layer, an interlayer, a green sensitive layer, an U.V. layer, a red sensitive layer, an U.V. layer and a surface overcoat.

In the photographic materials of the present invention various conventionally known hydrophilic colloids may optionally be used in combination with the carrier of the invention, so long as the transfer properties of the present carrier are capable of performing the desired function (e.g. transfer, adherence, colorfast). Examples of typical hydrophilic colloids used as the binders for photographic silver halide emulsions and other emulsions such as non-light sensitive emulsions (e.g., surface overcoat, interlayers, etc.) for the photographic layers include gelatin; sugar derivatives such as agar agar, sodium alginate, starch derivatives, etc.; casein; cellulose derivatives such as carboxymethyl cellulose, hydroxyethyl cellulose etc.; colloidal albumin; synthetic hydrophilic colloids such as polyvinyl alcohol, poly-N-vinylpyrrolidone, polyacrylic acid copolymers, maleic anhydride copolymers, polyacrylamide, the derivatives or partially hydrolyzed products thereof and water-dispersed vinyl polymers in the form of a latex. A mixture of two or more of these colloids may be used when the combination is compatible with each other.

The silver halide photographic emulsion used in the present invention may be prepared by mixing an aqueous solution of a water-soluble silver salt such as silver nitrate with an aqueous solution of a water soluble halogen salt such as potassium bromide in the presence of a carrier of the invention. The silver halide may be silver chloride, silver bromide, etc., or mixed silver halides such as silver chlorobromide, silver chloriodide, etc. These silver halide grains may be prepared according to conventionally known processes except that the carrier of the invention is used in place of conventional carriers. Examples of such known processes include the so-called single jet method, the so-called double jet method, or the controlled double jet method. In addition, two or more different silver halide emulsions separately prepared may be used together.

The silver halide photographic emulsions may also contain compounds to prevent the formation of fog during production, processing or preserving the photographic material, and to prevent a reduction in sensitivity. Suitable compounds for this purpose include 1-phenyl-5-mercaptotetrazole, 3-methylbenzothiazole, 4-hydroxy-6-methyl-1,3,3a,7-tetrazaindene and many metal salts, mercury-containing compounds, mercapto compounds and heterocyclic compounds, etc.

The silver halide emulsions may be chemically sensitized in a conventionally known manner. Suitable chemical sensitizers include gold compounds such as gold trichloride, salts of noble metals such iridium and rhodium; sulfur compounds capable of forming silver sulfide by causing reaction with a silver salt such as sodium thiosulfate; amines, stannous salts, and other reducing compounds.

Moreover, the silver halide photographic emulsions may be spectrally sensitized or super dye sensitized using cyanine dyes such as merocyanine, carbocyanine, or cyanine alone or in combinations thereof or using a combination of cyanine dyes and styryl dyes. The selection of such dyes depends upon the object and use of the photographic materials including the desired sensitivity and the wavelength regions.

The hydrophilic colloid layers may be hardened with cross-linking agents such as vinyl sulfate compounds, active halogen compounds, carboiimide compounds, etc.

The dye forming couplers suitably used in this invention include cyan, magenta and yellow dye forming couplers. These couplers may be 4-equivalent couplers or 2-equivalent couplers as described in U.S. Pat. Nos. 3,458,315 and 3,277,155.

Examples of suitable yellow dye-forming couplers include those described in U.S. Pat. Nos. 3,384,657, 3,277,155, 3,253,924, 3,227,550, 4,026,706, 2,428,054, 2,908,573, 2,778,658, 2,453,661 and 2,499,966.

Examples of suitable magenta dye forming couplers include those described in U.S. Pat. Nos. 4,206,706, 2,725, 292, 3,227,550, 2,600,788, 3,252,924, 3,062,653, 2,908,573, 3,152,896 and 3,311,476.

Examples of suitable cyan dye forming couplers which can be used in the invention include those described in U.S. Pat. Nos. 3,043,892, 4,026,706, 2,275,292, 3,253,294, 2,474,293, 3,227,550, 2,423,730, 2,908,573 and 2,895,826.

A further general discussion of suitable couplers is described in *Photographic Chemistry* by Glafkides, Volume 2, pages 596–615 and *Encyclopedia of Chemical Technology,* Vol. 5, pages 822–825.

The couplers may either be incorporated into the emulsion layers containing silver halide grains or added to the material upon processing (e.g. adding color couplers to the color developer such as by the Kodachrome process).

Dyes may be formed by the reaction of the couplers with an oxidized aromatic primary amine silver halide developing agent during conventional processing. Typical processing steps for color negative films and color print papers are development, bleach, fix, washing, optionally stabilization and then drying. Two or more of these steps may be combined into a single step. For instance, the bleaching and fixing steps may be combined into a single bleach-fix step. Color development is usually carried out in an alkaline solution containing an aromatic primary amine developing agent such as aminophenol, phenylenediamine or a mixture thereof.

Where it is desired to reverse the sense of the color image, such as in color slide processing, reversal processing can be undertaken. A typical sequence for reversing color processing includes black and white development, stop, washing, fogging, washing, color development, washing, bleaching, fixing, washing, stabilizing and drying. An optional prehardening bath prior to black and white development may be employed. The washing step can be omitted or relocated in the sequence. The fogging bath can be replaced by uniform light exposure or by the use of a fogging agent in the color development step to render the silver halide not developed in the black and white step developable.

When the color photographic material of the present invention is a color photographic diffusion transfer film unit the processing of the photographic material is carried out automatically in the photographic material. In these instant product type units, the color developer containing a color developing agent is contained in a rupturable container. Suitable developing agents include 1-phenyl-4-methylhydroxymethyl-3-pyrazolidone, 1-phenyl-3-pyrazolidone, N-methylamino-phenol, 1-phenyl-4,4-dimethyl-3-pyrazolidone, and 3-methoxy-N,N-diethyl-p-phenylenediamine.

Accordingly, in order to form color images in photographic materials various known methods can be used, including the coupling reaction of the above-described dye-forming color couplers and the oxidation products of a p-phenylenediamine series color developing agent; the oxidation cleavage reaction of DRR compounds, the dye releasing reaction upon coupling of DDR couplers; the dye forming reaction upon the coupling reaction of DDR couplers and a silver dye bleaching process.

Therefore, the present invention can be applied to various types of color photographic materials such as color positive films, color papers, color negative films, color reversal films, color diffusion transfer film units, silver dye bleaching photographic materials, black and white films and papers, etc.

Methods for preparing silver halide photographic elements of the present invention are well known in the art. Representative methods thereof are set forth in U.S. Pat. Nos. 4,822,728, 41743,533, 4,710,455, 4,705,747, 4,680,247, 4,659,647, 4,654,293, 4,636,457, 4,634,661, 4,619,884, 4,588,672, 4,565,778, 5,552,834, 4,529,690, 4,459,353, 4,499,174, 4,144,070, 4,379,837 and Reissue 32,149. Of course, the invention is obtained by substituting the claimed carrier for the carrier disclosed in the references.

The following examples are provided for a further understanding of the invention, however, the invention is not to be construed as being limited thereto.

EXAMPLE 1

A silver halide photographic material was prepared by crystallizing silver halide grains directly into the permeable portions of the transfer layer of FOTOWEAR GREEN LINE, obtained from Fotowear, Milford, Pa. This is known as a "salt paper" by one of ordinary skill in the art. No additional binder or carrier for the silver halide grains was added in sensitizing the material.

Papers were prepared as follows:

(1) The Green Line paper was saturated with a solution of potassium bromide dissolved in water.

(2) Paper was dried for 24 hours at ambient conditions, or dried by conventional forced air methods (e.g. blow dryer).

(3) The bromide saturated paper was soaked in a solution of silver nitrate which initiates the crystallization of light sensitive silver bromide throughout the porous regions of the transfer layer. These crystals are essentially insoluble in water and can only move around by mechanical means. Thus, in this example, the silver halide grains are not incorporated into the carrier as in conventional systems utilizing conventional carriers such as gelatin.

(4) The light sensitive Green Line paper was dried at room temperature and stored in the dark. The sensitized paper was then uniformly exposed to room light for about 30 seconds. The exposures were then developed in color development chemistry known in the art as working solution RA-4 (Eastman Kodak). The working solution RA-4 is a paper development color process. The color coupler magenta, cyan or yellow color coupling dye was added to the RA-4 working solution before development. Therefore, it is similar to the color development process known as the K-14 Kodachrome process (Eastman Kodak). Upon development, the color developer was able to pass through the porous carrier and develop the silver images. The test sample is a sample of what a magenta layer (red-blue hue) would look like if separated. The resulting uniform image contains both the silver and color coupled dyes. Both the material and dye image can withstand bleaching to remove silver, thereby leaving only the color image.

The image containing transfer layer was then separated from the support layer by pealing. The transfer layer was then dried by a forced air method. The dried image bearing transfer layer was then placed on a fabric receiving layer. A sheet of silicon paper was then placed on the transfer layer. The image was set to the fabric by placing heat by way of a conventional heating iron set to the highest heat setting. With images containing resolvable detail (e.g. human hair or grass), the transferred image, upon visual inspection, are as resolved as the original before transfer. In the test sample, the dye and silver image are present throughout the transfer layers. All samples represent one Green Line transfer without the addition of another supporting layer.

The formation of color in this image is only made possible by the photographic development process. With the efficient transfer of a single Green Line transfer layer, the fact that both the silver and dye records are present demonstrate that transfer of both black and white and color images are possible.

The Green line transfer paper, when magnified, is highly porous throughout the entire layer structure. This extensive porosity facilitates exchange of aqueous development chemistry, and would preclude the need for carrier swelling.

This example further demonstrates solution permeability of the transfer coating may provide a means of incorporating the silver halide into the transfer layer directly before coating onto a support. It also demonstrates that the convention gelatin carrier may be replaced in the photographic process.

EXAMPLE 2

A silver halide photographic material is prepared as follows. Silver halide grains are prepared by mixing a solution of silver nitrate with a solution of potassium bromide. Silver halides are grown in a traditional single jet conformation in a film forming binder such as 0.5–10% polyethylene, polyvinyl alcohol, poly acrylamide, gelatin or combinations. These grains (5–10 wt % based on total amount of silver halide emulsion and carrier defined below) are mixed into a heated solution (e.g. less than 70° C.) of carrier comprising:

| | | | |
|---|---|---|---|
| Michem 58035 | 5 parts | | |
| Michem 4983R | 1 part | Michelman Inc. | 30–80% |
| Retin 204LS | | Rohm and Haas | 10–5% |
| Microthene FE532 or FN500 | | Quantum Ind. | 50–10% |

(Bead size 1–20 microns with a reported melting temperature of 80 to 180° C.)

Thus, in this example, the silver halide grains are incorporated into the carrier as in conventional systems utilizing carriers such as gelatin. The photographic emulsion (e.g. silver halide grains and carrier) are coated onto a fiber based paper support which is not coated on both sides with polyethylene.

The sensitized paper is then exposed to room light for about 30 seconds and then developed in color development chemistry known in the art as RA-4 (Eastman Kodak) as in Example 1. After development, the same steps as in Example 1 are followed.

EXAMPLE 3

A silver halide photographic transfer element is prepared as follows. A conventional package of color paper silver halide photographic light sensitive emulsions (except for the carrier) is coated on a fiber based paper support which is not coated with polyethylene on both surfaces thereof. The carrier which is used is Formulation A:

| | | | |
|---|---|---|---|
| Michem 58035 | 5 parts | | |
| Michem 4983R | 1 part | Michelman Inc. | 40–85% |
| Retin 204LS | | Rohm and Haas | 10–5% |
| Microthene FE532 or FN500 | | Quantum Ind. | 50–10% |

(Bead size 1–20 microns with a reported melting temperature of 80 to 180° C.)

All quantities below are in terms of grams per square meter unless otherwise specified.

Layer 1 comprises 1.5 g of Formulation A, 0.32 g of a blue-sensitive silver chlorobromide emulsion, and 0.3 g of dioctyl phthalate (DOP) in which $1.2\times10^{-3}$ mol of α-(1-benzyl-2-phenyl-3,5-dioxo-1,2,4-triazolidinyl)-α-pivalyl-2-chloro-5-[α-(dodecyloxycarbonyl)ethoxycarbonyl] acetanilide as a yellow coupler and 0.015 g of 2,5-di-t-ocytl hydroquinone (HQ).

Layer 2 is an interlayer which comprises 0.9 g of Formulation A and 0.6 g of DOP in which 0.09 of HQ is dissolved.

Layer 3 comprises 1.3 g of Formulation A, 0.27 g of a green sensitive silver chlorobromide emulsion, and 0.2 g of DOP in which $0.59\times10^{-3}$ mol of 1-(2,4,6-trichlorophenyl)-3-(2-chloro-5-octadecylsuccinimide-anilino)-5-pyrazolone as a magenta coupler and 0.015 g of HQ are dissolved.

Layer 4 comprises 1.5 g of Formulation A and 0.6 g of DOP in which 0.8 g benzophenone as an ultraviolet absorbent and 0.04 g of HQ are dissolved.

Layer 5 comprises 1.6 g of Formulation A, 0.3 g of a red sensitive silver chlorobromide emulsion and 0.2 g of DOP in which $0.75\times10^{-3}$ mol of 2,4-dichloro-3-methyl-6-[α-(2,4-di-t-amylphenoxy)-butylamide]phenol as a cyan coupler and 0.005 g of HQ are dissolved.

Layer 6 is a surface overcoat (e.g., protective layer) and comprises 1.0 g of Formulation A.

The color print paper thus produced is exposed to light through a standard negative.

The exposed color print paper sample is processed as follows. The sample is processed in a color developer having a temperature of 33° C. for 3.5 minutes. The developed sample is placed in a solution of bleach-fix at a temperature of 33° C. for 1.5 minutes. The sample is washed for 3 minutes with water maintained at 30°–34° C. Finally, the sample is dried for 2 minutes at a temperature of 60°–80° C.

The composition of the above-mentioned color developer is listed below:

| | |
|---|---|
| Pure water | 800 ml |
| Ethylene glycol | 15 ml |
| Benzyl alcohol | 15 ml |
| Hydroxylamine sulfate | 2 g |
| Potassium carbonate | 32 g |
| Potassium bromide | 0.65 g |
| Sodium chloride | 1.0 g |
| Potassium sulfite | 2.0 g |
| N-ethyl-N-beta-methanesulfonamide ethyl-3-methyl-4-aminoaniline sulfate | 4.5g |
| Whitex BB (in 50% aqueous solution) (Optical whitening agent, mfd. by Sumitomo Chemical Ind. Co. Ltd., Japan) | 2 ml |
| 1-hydroxyethylidene-1, 1 diphosphonic acid (in 60% aqueous solution) | 2 ml |

Pure water is added therein to make 1 liter and the pH value thereof is adjusted by the use of 10% potassium hydroxide or dilute sulfuric acid solution to pH=10.1.

The composition of the bleach-fix solution is listed below:

| | |
|---|---|
| Pure water | 550 ml |
| Color Developer | 200 ml |
| Iron (III) ammonium ethylenediamine tetraacetic acid | 65 g |
| Ammonium thiosulfate | 85 g |

-continued

| | |
|---|---|
| Sodium hydrogensulfite | 10 g |
| Sodium metahydrogensulfite | 2 g |
| Di-ethylenediaminetetraacetate | 12 g |
| Sodium bromide | 10 g |
| Potassium chloride | 1.0 g |

Pure water is added thereto to make 1 liter and the pH value is adjusted to pH=7.0 with the use of dilute sulfuric acid or concentrated aqueous ammonia.

EXAMPLE 4

Figure 2:
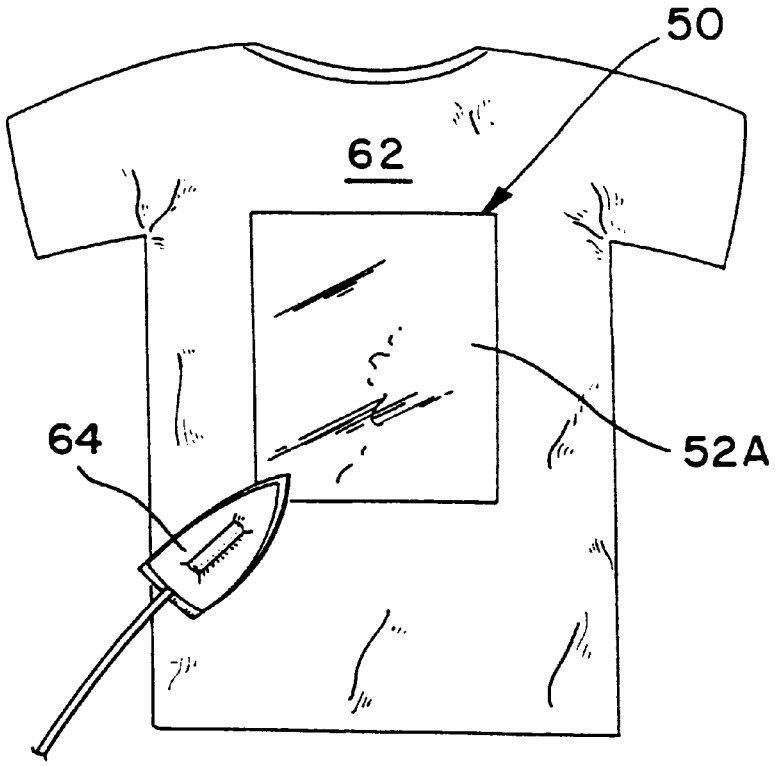

Referring to FIG. 2, the method of applying a photographic image to a receptor element will be described. More specifically, FIG. 2 illustrates how the step of heat transfer from the silver halide photographic transfer element (50) to a tee shirt or fabric (62) is performed.

The silver halide photographic transfer element is prepared, exposed and developed to form a photographic image as in Example 1. A tee shirt (62) is laid flat, as illustrated, on an appropriate support surface, and the front surface of the silver halide photographic transfer element (50) is positioned onto the tee shirt. An iron (64) is run and pressed across the back (52A) of the silver halide photographic transfer element. The image is transferred to the tee shirt and the support is removed and discarded.

EXAMPLE 5

This Example is identical to Example 3, except that in layer(s) 3–6, gelatin is used in place of the carrier of the invention.

EXAMPLE 6

Example 4 is repeated, except that the material of Example 5 is used.

EXAMPLE 7

An integral imaging receiver (IIR) element is prepared by coating the following layers in the order recited on a transparent poly(ethylene terephthalate) film support. Quantities are parenthetically given in grams per square meter unless otherwise stated.

(1) Image receiving layer of poly(styrene-co-N-benzyl-N,N-dimethyl-N-vinylbenzyl-ammonium chloride-co-divinylbenzene) (molar ratio 49/49/2) (1.1) and Formulation A as carrier (1.2);

(2) Image receiving layer of poly(styrene-co-1-vinylimidazole-co-3-benzyl-1-vinylimidazolium chloride) (50:40:10 mole ratio) (1.6) and Formulation A as carrier (0.75);

(3) Reflecting layer of titanium dioxide (17) and Formulation A as carrier (2.6);

(4) opaque layer of carbon black (0.95) and Formulation A as carrier (0.65);

(5) Formulation A as carrier for interlayer (0.54);

(6) Formulation A as carrier for interlayer (0.65);

(7) Cyan redox dye-release layer;

(8) Formulation A as carrier for interlayer;

(9) Red sensitive silver halide emulsion layer and Formulation A as carrier;

(10) Formulation A as carrier for interlayer;

(11) Magenta-redox dye-releaser layer;

(12) Green-sensitive silver halide emulsion layer and Formulation A as carrier;

(13) Formulation A as carrier for interlayer;

(14) Yellow redox dye-releaser layer;

(15) Blue-sensitive silver halide emulsion layer and Formulation A as carrier; and

(16) Formulation A as carrier for overcoat layer.

Layers 8–17 are similar to those described in Example I of U.S. Pat. No. 4,356,250.

A cover sheet and processing pod are prepared and assembled into film assemblages. (For example, see Example I of U.S. Pat. No. 4,356,250).

The above film assemblages are exposed to a test object. The assemblages are processed in a conventional manner by spreading the contents of the processing pod between the cover sheet and the Integral Imaging Receiver by using a pair of juxtaposed rollers.

EXAMPLE 8

The method of Example 4 is repeated using the IIR element of Example 7. A tee shirt is laid flat on a suitable support surface and the front surface of the IIR element is positioned onto the tee shirt. An iron is run and pressed across the back of the IIR element and the image is transferred to the tee shirt.

EXAMPLE 9

Example 7 is repeated except layers 8–16 are the same as Example I of U.S. Pat. No. 4,356,250.

EXAMPLE 10

The method of Example 4 is repeated using the material of Example 9.

EXAMPLE 11

A multilayer light sensitive color reversal element comprising layers having the following composition is coated on a cellulose triacetate film support.

(1) An antihalation layer comprising Formulation A as a carrier containing black colloidal silver at a silver coating weight of 0.2 g/m$^2$.

(2) A red sensitive low speed emulsion layer of Formulation A as a carrier comprising a silver bromo-iodide emulsion (silver iodide: 7% by mol; average grain size: 0.65$\mu$) at a silver coating weight of 0.62 g/m$^2$ and a silver/carrier (Formulation A) ratio of 0.30, sensitizing dye I in an amount of 0.000135 mol per mol of silver, sensitizing dye II in an amount of 0.000316 mol per mol of silver, Coupler A in an amount of 0.211 mol per mol of silver dispersed in tricresylphosphate and diethylauramide.

(3) A red sensitive high speed emulsion layer of Formulation A as a carrier comprising a silver bromo-iodide emulsion (silver iodide: 7% by mol; average grain size: 1.18$\mu$) at a silver coating weight of 0.57 g/m$^2$ and a silver/carrier(Formulation A) ratio of 0.30, sensitizing dye I in amount of 0.000123 mol per mol of silver, Coupler A in an amount of 0.221 mol per mol of silver dispersed in tricresylphosphate and diethyl-lauramide.

(4) An intermediate layer of Formulation A as a carrier comprising 2,5-ditert-octylhydroquinone dispersed in tricreslphosphate.

(5) A green sensitive high speed emulsion layer of Formulation A as a carrier comprising a silver bromo-iodide emulsion (silver iodide: 7% of mol, average grain size: 1.18$\mu$) at a silver coating weight of 0.63 g/m$^2$ and a silver/carrier (Formulation A) ratio of 0.46, sensitizing dye III in an amount of 0.000866 mol per mol of silver sensitizing dye IV in an amount of 0.000190 mol per mol of silver, Coupler B in an amount of 0.183 mol per mol of silver.

(6) A green sensitive low speed emulsion layer of Formulation A as a carrier comprising a blend of a silver bromo-iodide emulsion (silver iodide: 7% by mol; average grain size: 0.65$\mu$) and a silver bromo-iodide emulsion (silver iodide: 5% by mol; average grain size 0.29$\mu$) at a total silver coating weight of 0.46 g/m$^2$ and a total silver/carrier (Formulation A) ratio of 0.41, sensitizing dye III in an amount of 0.000935 mol per mol of silver, sensitizing dye IV in an amount of 0.00021 mol per mol of silver and Coupler B in an amount of 0.132 mol per mol of silver.

(7) An intermediate layer the same as layer (4).

(8) A yellow filter layer of Formulation A as a carrier comprising dispersed yellow colloidal silver.

(9) A blue sensitive high speed emulsion layer of Formulation A as a carrier comprising a blend of a silver bromo-iodide emulsion (silver iodide: 7% by mol, average grain size: 1.18$\mu$) and a silver bromo-iodide emulsion (silver iodide: 14% by mol; average grain size: 1.4$\mu$) at a total silver coating weight of 0.85 g/m$^2$ and a total silver/carrier (Formulation A) ratio of 0.52, sensitizing dye V in an amount of 0.00015 mol per mol of silver, Coupler C in an amount of 0.145 mol per mol of silver and Coupler D in an amount of 0.071 mol per mol of silver both dispersed in tricresylphosphate and diethylalauramide.

(10) A blue sensitive low speed emulsion layer of Formulation A as a carrier comprising a silver bromo-iodide emulsion (silver iodide: 7% by mol; average grain size: 0.65 A) at a silver coating weight of 0.55 g/m$^2$ and a silver/gelatin ratio of 0.46, sensitizing dye V in an amount of 0.000133 mol per mol of silver, Coupler C in an amount of 0.147 mol per mol of silver and Coupler D in an amount of 0.071 mol per mol of silver both dispersed in tricresylphosphate and diethyllauramide.

(11) A protective layer of Formulation A as a carrier comprising polymethylmethacrylate particles of mean diameter 2$\mu$ and 2-(2'-hydroxy-3'5'-di-t-butylphenyl)-5-t-butylbenzotriazole UV absorber dispersed in tricresylphosphate and dibutylphthalate.

Surface active agents and antifogging agents are also added to the layers.

The element is exposed and processed through a reversal color process E6 described in "Using Process E6, Kodak Publication N2-119".

Compounds which may be used for preparing the above-described element are the following.

Sensitizing Dye I:

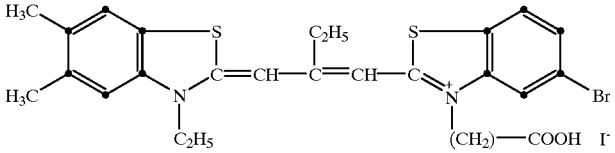

Sensitizing Dye II:

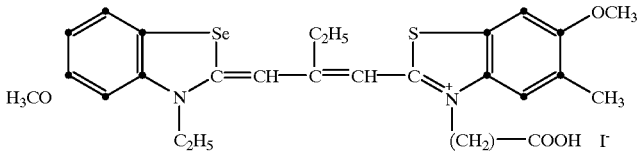

Coupler A:

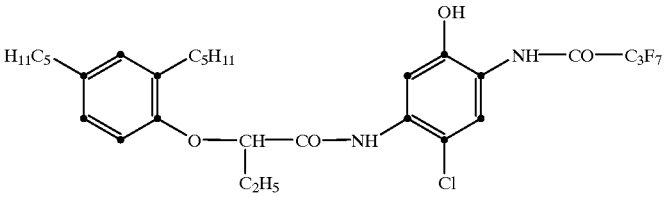

Sensitizing Dye III:

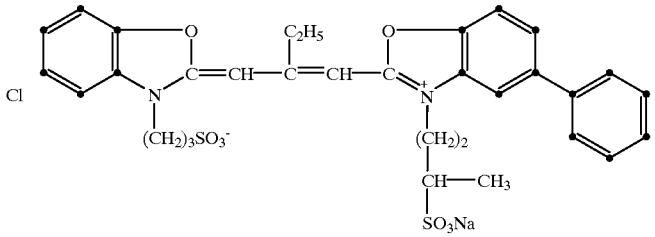

-continued

Sensitizing Dye IV:

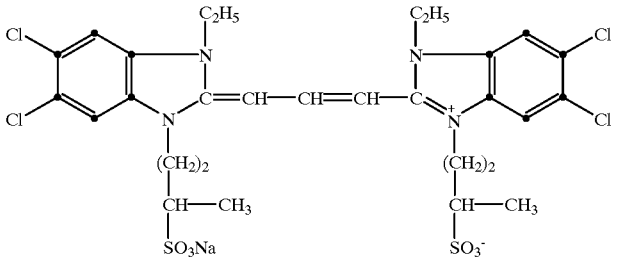

Coupler B:

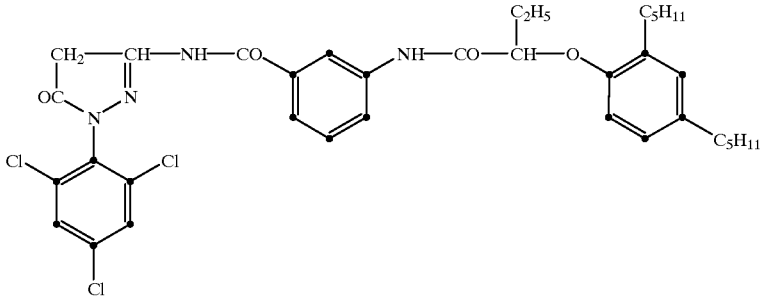

Sensitizing Dye V:

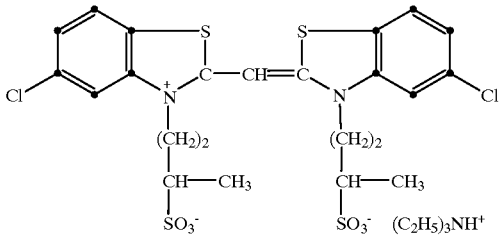

Coupler C:

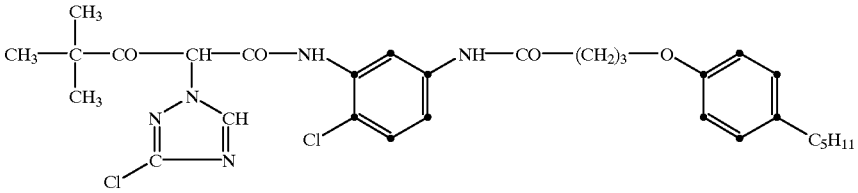

Coupler D:

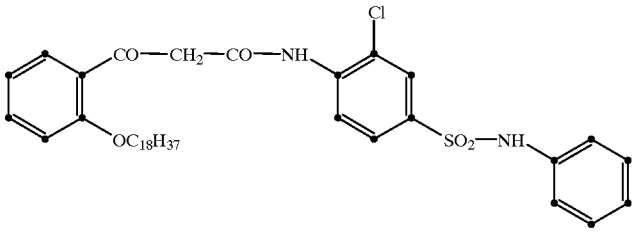

EXAMPLE 12

The multilayer light sensitive color reversal element of Example 7 is applied to a tee shirt in the manner set forth in Example 4.

EXAMPLE 13

This Example is identical to Example 11, except that in layers 4–11, gelatin is used in place of the carrier of the invention.

EXAMPLE 14

The material of Example 13 is applied to a tee shirt in the manner set forth in Example 4.

EXAMPLE 15

A paper support which is not coated on both sides with polyethylene is coated with a melt-transfer layer consisting of a mixture of Michem® 58035 and Michem® Prime 4983. Both materials are available from Michelman, Inc., Cincinnati, Ohio. A ratio of four or five to one of 58035 to 4983 is used. The basis weight of the melt-transfer layer is 8 g/m$^2$. Michem®-58-035 is a 35 percent solids dispersion of Allied Chemical's AC 580, which is approximately 10 percent acrylic acid and 90 percent ethylene. The polymer reportedly has a softening point of 102° C. and a Brookfield viscosity of 0.65 Pas (650 centipoise) at 140° C. Michem® Prime 4983 is a 25 percent solids dispersion of Primacor®5983 made by Dow Chemical Company. The polymer contains 20 percent acrylic acid and 80 percent ethylene. The copolymer has a Vicat softening point of 43° C. and a ring and ball softening point of 100° C. The melt flow rate of the copolymer is 500 g/10 minutes.

The melt-transfer layer then is coated with a carrier comprising particles of a thermoplastic polymer, a binder, and a cationic polymer, said carrier containing silver halide grains formed as in Example 2. When the thermoplastic binder and/or the binder are the variables, the cationic polymer in every case is an amide-epichlorohydrin copolymer, namely, either Kymene® 557 or Reten® 204LS, both being supplied by Hercules Inc., Wilmington, Del. The cationic polymer is included at a level of 5 weight percent, based on the weight of the thermoplastic polymer. The carrier is dried by heating at 80°–95° C. The basis weight of the carrier layer is 15 g/m$^2$.

In general, a minimum amount of binder is used. For example, 10 weight percent of a polyacrylate, Rhoplex® B-15 (Rohm and Haas Company) may be used. Excess binder is expected to reduce the porosity of the carrier layer and make it less absorbent. Another binder which may be used at the 10 weight percent level is Michem® 58035, described above. The binder must be compatible with the cationic polymer. Two binders which are more compatible with the cationic polymer and which yellow less than the Michem® 58035 are Airflex® 124 and Airflex® 125, both poly(vinyl alcohol) stabilized ethylene-vinyl acetate copolymers. The materials are available from Air Products and Chemicals, Inc., Allentown, Pa.

Several thermoplastic polymers may be used including Microthene® FE 532, an ethylene-vinyl acetate copolymer supplied by USI Chemicals Co., Cincinnati, Ohio. The particle size is reported to average approximately 20 micrometers. The Vicat softening point is 75° C. The melt flow rate of the copolymer is 9 g/10 minutes and it is reported to have a density of 0.928 g/cm$^3$. Another thermoplastic polymer is Microthene® FN 500, a low density polyethylene powder also supplied by USI Chemicals Co. The material has an average particle size of 20 micrometers, a Vicat softening point of 83° C., a melt flow rate of 22 g/10 minutes, and a density of 0.915 g/cm$^3$.

The material is exposed, developed and transferred as in Example 4.

EXAMPLE 16

Example 15 is repeated without the melt-transfer layer.

EXAMPLE 17

Example 15 is repeated, but using the following thermoplastic polymers:

Thermoplastic Polymer A

This polymer is Microthene® FE 532, described in Example 15.

Thermoplastic Polymer B

This material is Microthene® FN-500, also described in Example 15.

Thermoplastic Polymer C

Thermoplastic Polymer C is Corvel® 2093. It is a polyester. The average particle size is 20 micrometers, the melting point of the polymer is approximately 80° C., and the melt flow rate is reported to be "high". The material is supplied by Powder Coatings Group of the Morton Chemical Division, Morton Thiokol, Inc., Reading, Pa.

Thermoplastic Polymer D

This polymer is MP 22, described in Example 15.

Thermoplastic Polymer E

Thermoplastic Polymer E is MPP 611, also described in Example 15.

Thermoplastic Polymer F

This material is MPP 635, also a polyethylene supplied by Micro Powders, Inc. The average particle size of the polymer is 5 micrometers, the melting point is reported to be 124, and the melt flow rate is "high".

Thermoplastic Polymer G

This polymer is Accumist® B6, supplied by Allied Chemical Company, Morristown, N.J. The polymer is a polyethylene having a melting point of 126° C. The average particle size of the polymer is 6 micrometers and the melt flow rate is "high".

Thermoplastic Polymer H

Thermoplastic Polymer H is Accumist® B12, also supplied by Allied Chemical Company. The polymer is a high density polyethylene having a melting point of 126° C. The average particle size of the polymer is 12 micrometers.

Thermoplastic Polymer I

This polymer is DPP 714, a polystyrene dispersion supplied by Dow Chemical Company, Midland, Mich.

Thermoplastic Polymer J

This material is Piccotex® LC55R, a styrene-methyl styrene copolymer dispersion supplied by Hercules, Inc.

Thermoplastic K

Thermoplastic Polymer K is DL 256, a polystyrene dispersion also supplied by Dow Chemical Company.

Thermoplastic L

This polymer is BN 4901X, a polystyrene dispersion available from BASF Corporation, Sarnia, Ontario, Canada.

Thermoplastic M

This material is Ropaque®, a polystyrene dispersion supplied by Rohm and Haas Company, Philadelphia, Pa.

Four different binders are used:

Binder A

Binder A is Carboset® 514H, a polyacrylate binder dispersed in water, supplied by B.F. Goodrich Company, Cleveland, Ohio.

Binder B

This binder is Rhoplex® B15, described in Example 15.

Binder C

Binder C is Michem® 58035, also described in Example 15.

Binder D

This binder is Marklube® 542, a cationic low density polyethylene emulsion from Ivax Industries, Inc., Rock Hill, S.C.

The composition of the carrier layer is summarized in Table 1 below. In the Table, the "TP" column identifies the thermoplastic polymer by letter, the "Type" column identifies the binder by letter, and basis weights are given in g/m$^2$.

TABLE 1

Summary of Carrier Composition with Various Thermoplastic Polymers

| | Binder | | Basis |
|---|---|---|---|
| TP | Type | Wt. % | Weight |
| A | A | 10 | 21 |
| A | B | 10 | 23 |
| A | C | 10 | 23 |
| A | C | 20 | 23 |
| B | C | 50 | 31 |
| B | C | 10 | 23 |
| C | C | 10 | 32 |
| D | C | 10 | 30 |
| E | C | 10 | 23 |
| E | C | 12.5 | 28 |
| E | C | 12.5 | 8 |
| E | C | 12.5 | 13 |
| F | C | 10 | 23 |
| F | C | 12.5 | 13 |
| F | C | 18 | 11 |
| F | C | 20 | 13 |
| F | D | 25 | 13 |
| G | C | 18 | 13 |
| H | C | 18 | 13 |
| I | C | 10 | 17 |
| J | C | 10 | 17 |
| K | C | 10 | 8 |
| L | C | 10 | 8 |
| M | C | 10 | 8 |
| M | C | 30 | 8 |
| M | C | 40 | 8 |

EXAMPLE 18

Example 17 is repeated without the melt-transfer layer.

EXAMPLE 19

A base sheet of fiber based paper which is not coated with polyethylene on both sides is coated with a low molecular weight polymer film layer, referred to hereinafter as the first layer. The next layer was a film based on a polymer having a higher molecular weight, referred to hereinafter as the second layer. Finally, the carrier (on top of the second layer) consisted mainly of low molecular weight polyethylene wax particles, plus silver halide grains as described in Example 2.

A number of multi layered samples (including the base sheet) are evaluated. In every case, the carrier layer consisted of 77 weight percent MPP 635 (Thermoplastic Polymer F), 8 weight percent of BN 4901X (Thermoplastic Polymer L), 10 weight percent Michem® 58035 (Binder C), 4 weight percent Reten® 204LS (cationic polymer), and 1 weight percent Triton® X-100, a surfactant, all based on the total weight of the layer (excluding silver halide grains). These weights of binder, cationic polymer, and surfactant are equivalent to 12, 5 and 1 weight percent, respectively, based on the weight of thermoplastic polymer.

A preferred sample using this format contains the following:

First layer: The layer consisted of 45 weight percent Michem® 4983 and 55 weight percent Chemawax® 40. The layer is applied as a mixed latex. The basis weight of the layer was 8 g/m$^2$.

Second layer: The layer, located adjacent to the paper, consisted of Epolene® C13 which is formed by melt extrusion at a basis weight of 20 g/m$^2$. The polymer is a 200 melt flow rate low density polyethylene obtained from Eastman Chemical Products, Inc., Kingsport, Tenn.

Another material which may be used as the second layer and which can be extrusion coated on the paper base sheet is Nucrel® RX 62, supplied by E.I. Du Pont de Nemours and Company, Inc., Wilmington, Del. The polymer is an ethylene-methacrylic acid copolymer having 10 weight percent methacrylic acid and a melt flow rate of around 500 g/10 min.

The material is exposed, developed and transferred as in Example 4.

EXAMPLE 20

This Example evaluates various cationic polymers. Two types of carrier layers are employed, in which the cationic polymer is included as a component. Type A consists of Microthene® FE 532 (Thermoplastic Polymer A), 13 weight percent of Michem® 58035 binder (Binder C), based on the weight of the thermoplastic polymer, 1 weight percent Triton® X-100 surfactant, and the cationic polymer. The basis weight of the layer is 15 g/m$^2$. The Type B layer consists of MPP 635 (Thermoplastic Polymer F), 18 weight percent of Michem® 58035 binder (Binder C), based on the weight of the thermoplastic polymer, 1 weight percent Triton® X-100 surfactant, and the cationic polymer. The basis weight of the layer was 13 g/m$^2$. When The Type B second layer is employed, a third layer consisting of Michem® 58035 at a basis weight of 17 g/m$^2$ is employed, adjacent to the paper support. The various cationic polymers evaluated are as follows:

Cationic Polymer A

Cationic Polymer A is Kymene® 557, an amide-epichlorohydrin copolymer available from Hercules, Inc.

Cationic Polymer B

This polymer is Calgan® 261LV, a quaternary polymer. It is available from Calgon Corporation.

Cationic Polymer C

This material is Corcat® P145. It is a polyethyleneimine supplied by Cordova Chemical Company.

Cationic Polymer D

Cationic Polymer D is Parez® 631NC, a polyacrylamide available from American Cyanamide.

Cationic Polymer E

This material is Betz® 1260. It is obtained from Betz Paperchem, Trevose, Pa.

Cationic Polymer F

This polymer is Reten® 204LS, an amide-epichlorohydrin copolymer available from Hercules, Inc.

Cationic Polymer G

Verona ® C-300 from Miles Inc., Pittsburgh, P

Cationic Polymer H

Aquaprox® UP103 from Synthron, Morgantown, N.C.

Cationic Polymer I

Tinofix® EW from Ciba-Geigy Corporation, Hawthorn, N.Y.

Cationic Polymer J

Reactofix® ES from Ivax Industries, Inc.

Cationic Polymer K

Protefix® TS, a cationic carbamide from Synthron.

In the table, the column "CP" Type" identifies the cationic polymer, whereas the column "Type" identifies the type of carrier employed, as described above.

TABLE 4

Evaluation of Various Cationic Polymers

| CP Type | Amount | Type |
|---|---|---|
| A | 2 | A |
| A | 4 | A |
| A | 6 | A |
| B | 2 | A |
| B | 4 | A |
| C | 2 | A |
| C | 4 | A |
| D | 2 | A |
| D | 4 | A |
| E | 2 | A |
| F | 5 | A |
| F | 4 | A |
| F | 8 | A |
| G | 8 | B |
| H | 8 | B |
| I | 8 | B |
| J | 8 | B |
| K | 8 | B |

The silver halide grains as described in Example 2 are incorporated into the carrier layer, which is coated on (i) a fiber base paper which is not coated on both sides with polyethylene and (ii) transparent polyacetate film. The material is exposed, developed and transferred as described in Example 4.

EXAMPLE 21

The formulations involving Cationic Polymer F as reported in Example 20 are modified further since yellowing may be encountered when images are heat transferred.

In the experiments, the paper base which is not coated on both sides with polyethylene is extrusion coated with 44 g/m$^2$ of Nucrel® RX62, an ethylene-methacrylic acid copolymer having a melt flow rate of 600 g/10 minutes supplied by E.I. Du Pont de Nemours and Co., Inc. The second layer had a basis weight of approximately 13 g/m$^2$.

The binder employed in the carrier layer (e.g. containing silver halide grains as described in Example 2) is either Airflex® 124 (Binder E) or Airflex 125® (Binder F). The binder is present at a level of 26 weight percent, based on the weight of the thermoplastic polymer. The cationic polymer used is Reten® 204LS, the humectant is Polyglycol® E200, a poly(ethylene glycol) from Dow Chemical Company having a weight-average molecular weight of about 200; the humectant level is 10 weight percent, based on the weight of the thermoplastic polymer. The surfactant is Triton® X-100 at a level of 3 weight percent, based on the weight of thermoplastic polymer employed. The fluid viscosity modifier is Polyox® N80 at a level of 3 weight percent, also based on the weight of the thermoplastic polymer. The thermoplastic polymers evaluated included micropowders MPP 635 and Accumist® A-12, from Micropowders and Allied Chemical Company, respectively. The material is exposed, developed and transferred as described in Example 4.

The experiments are summarized in Table 5. In the table, the "TP" column identifies the thermoplastic polymer by letter (see Example 17), the "WT.-% CP" column identifies the amount of Reten® 204LS employed in the second layer in weight percent, based on the weight of the thermoplastic polymer, and the "WT.-% Acid" column identifies the amount of citric acid included in the carrier, in weight-percent based on the weight of the thermoplastic polymer.

TABLE 5

Summary of Cationic Polymer F Formulation Modifications

| Sample | Binder | TP | Parts CP | Wt.-% Acid |
|---|---|---|---|---|
| 1 | F | H | 8 | None |
| 2 | F | H | 8 | 4 |
| 3 | E | H | 8 | None |
| 4 | F | F | 8 | None |
| 5 | F | F | 12 | None |
| 6 | F | F | 16 | None |

All cited patents and publications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A silver halide photographic element, which comprises:

a support having a front and rear surface, and at least one silver halide light sensitive emulsion layer consisting essentially of light sensitive silver halide grains on said front surface of the support, with the proviso that the silver halide grains are non-organic silver salts, and with the proviso that said emulsion layer does not contain a dye donating substance other than a color coupler, wherein the silver halide grains are dispersed in or mixed with a carrier having a melting point of at least 100° C. and which is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of said silver halide grains and wherein said carrier is substantially photographically inert and acts only as a binding agent, except that it is capable of melting, transferring and adhering upon the application of heat.

2. The silver halide photographic element of claim 1, wherein the silver halide light sensitive emulsion layer is a color light sensitive photographic layer in color negative film, color reversal film, color reversal paper, color positive film or color print paper.

3. The silver halide photographic element of claim 1, wherein the silver halide light sensitive emulsion layer is a light sensitive photographic layer in a black and white film or paper photosensitive material.

4. The silver halide photographic element of claim 1, wherein the receptor surface is textile, leather, ceramic, wool, glass, plastic or metal.

5. The silver halide photographic element of claim 4, wherein the textile is a shirt.

6. A silver halide photographic element, which comprises:

a support having a front and rear surface, and at least one silver halide light sensitive emulsion layer containing light sensitive silver halide grains on said front surface of the support, with the proviso that the silver halide grains are non-organic silver salts, and with the proviso that said emulsion layer does not contain a dye donating substance other than a color coupler, wherein the silver halide grains are dispersed in or mixed with a carrier which comprises particles of from 1 to 20 micrometers and said carrier having a melting point of at least 100° C. and which is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of said silver halide grains.

7. A silver halide photographic element which comprises a support, an optional subbing layer, a first silver halide light sensitive emulsion layer containing light sensitive silver halide grains mixed with a carrier, an optional overcoat or optional interlayer, and optionally a second silver halide light sensitive emulsion layer, an optional interlayer, an optional third silver halide light sensitive emulsion layer, and an optional overcoat with the proviso that silver halide grains in the first and optional second and third silver halide light sensitive emulsions are non-organic silver salts, and with the proviso that said first and optional second and third silver halide emulsion layers do not contain a dye donating substance other than a color coupler, wherein at least one of the optional subbing layer, overcoat or interlayer must be present and also comprises said carrier, wherein said carrier is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of said silver halide grains.

8. A silver halide photographic element which comprises a support, an optional subbing layer, a first silver halide light sensitive emulsion layer containing light sensitive silver halide grains mixed with a carrier, an optional overcoat or optional interlayer, and optionally a second silver halide light sensitive emulsion layer, an optional interlayer, an optional third silver halide light sensitive emulsion layer, and an optional overcoat, wherein at least one of the optional subbing layer, overcoat or interlayer must be present and also comprises said carrier, wherein said carrier is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of said silver halide grains.

9. The silver halide photographic element of claim 1, wherein said carrier is present in an effective amount to provide colorfastness of the image and non-image areas on a receptor element.

10. A silver halide photographic element, which comprises:

a support having a front and rear surface, and at least one silver halide light sensitive emulsion layer containing light sensitive silver halide grains on said front surface of the support, with the proviso that the silver halide grains are non-organic silver salts, and with the proviso that said emulsion layer does not contain a dye donating substance except for a color coupler, wherein the silver halide grains are dispersed in or mixed with a carrier having a melting point of at least 100° C. and comprising (i) particles of a thermoplastic polymer having dimensions of about 1 to about 20 micrometers, from about 10 to about 50 weight percent of a film-forming binder, based on the weight of the thermoplastic polymer, and optionally from about 0.2 to about 10 weight percent of a fluid viscosity modifier, based on the weight of the thermoplastic polymer, (ii) about 15 to about 80 percent by weight of a film-forming binder selected from the group consisting of ethylene-acrylic acid copolymers, polyolefins, and waxes and from about 85 to about 20 percent by weight of a thermoplastic polymer selected from the group consisting of polyolefins, polyesters, polyamides, waxes, epoxy polymers, ethylene-acrylic acid copolymers, and ethylene-vinyl acetate copolymers, wherein each of said film-forming binder and said thermoplastic polymer melts in the range of from about 100° C. to about 180 degrees Celsius and particles of about 1 to about 20 micrometers, (iii) a film forming binder selected from the group consisting of ethylene-acrylic acid copolymers having particles of about 1 to about 20 micrometers, polyolefins, and waxes and which melts in the range of from about 100° C. to about 180 degrees Celsius, (iv) a thermoplastic polymer having particles of about 1 to about 20 micrometers selected from the group consisting of polyolefins, polyesters, and ethylene-vinyl acetate copolymers and which melts in the range of from about 100 to about 180 degrees Celsius or, (v) a thermoplastic polymer having particles of about 1 to about 20 micrometers selected from the group consisting of polyolefins, polyesters, and ethylene-vinyl acetate copolymers, ethylene-methacrylic acid copolymers, and ethylene-acrylic acid copolymers and which melts in the range of from about 100 to about 180 degrees Celsius.

11. A silver halide photographic element, which comprises:

a support having a front and rear surface, and at least one silver halide light sensitive emulsion layer containing light sensitive silver halide grains on said front surface of the support, with the proviso that the silver halide grains are non-organic silver salts, and with the proviso that said emulsion layer does not contain a dye donating substance other than a color coupler, wherein the silver halide grains are dispersed in or mixed with a carrier having a melting point of at least 100° C. and which is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of said silver halide grains, and wherein the carrier comprises particles of a thermoplastic polymer having dimensions of about 1 to about 20 micrometers, from about 10 to about 50 weight percent of a film-forming binder, based on the weight of the thermoplastic polymer, and from about 0.2 to about 10 weight percent of an viscosity modifier, based on the weight of the thermoplastic polymer.

12. A silver halide photographic element, which comprises:

a support having a front and rear surface, and at least one silver halide light sensitive emulsion layer containing light sensitive silver halide grains on said front surface of the support, with the proviso that the silver halide grains are non-organic silver salts, and with the proviso that said emulsion layer does not contain a dye donating substance other than a color coupler, wherein the silver halide grains are dispersed in or mixed with a carrier having a melting point of at least 100° C. and which is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of said silver halide grains, and wherein the carrier melts from about 100 to about 180 degrees Celsius and comprises particles of a thermoplastic polymer having dimensions of about 1 to about 20 micrometers, from about 10 to about 50 weight percent of a film-forming binder, based on the weight of the thermoplastic polymer, and from about 2 to about 20 weight percent of a cationic polymer, based on the weight of the thermoplastic polymer.

13. A silver halide photographic element, which comprises:

a support having a front and rear surface, and at least one silver halide light sensitive emulsion layer containing light sensitive silver halide grains on said front surface of the support, with the proviso that the silver halide grains are non-organic silver salts, and with the proviso that said emulsion layer does not contain a dye donating substance other than a color coupler, wherein the silver halide grains are dispersed in or mixed with a carrier having a melting point of at least 100° C. and which is capable of transferring and adhering developed image and non-image areas from said front surface of said support upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of said silver halide grains, and wherein the carrier comprises from about 15 to about 80 percent by weight of a film-forming binder selected from the group consisting of ethylene-acrylic acid copolymers, polyolefins, and waxes and from about 85 to about 20 percent by weight of a powdered thermoplastic polymer selected from the group consisting of polyolefins, polyesters, polyamides, waxes, epoxy polymers, ethylene-acrylic acid copolymers, and ethylene-vinyl acetate copolymers, wherein each of said film-forming binder and said powdered thermoplastic polymer melts in the range of from about 100 to about 180 degrees Celsius and said powdered thermoplastic consists of particles which are from about 1 to about 20 micrometers in diameter.

14. The silver halide photographic element of claim 1, wherein the carrier comprises a film forming binder selected from the group consisting of ethylene-acrylic acid copolymers, polyolefins, and waxes and which melts in the range of from about 100 to about 180 degrees Celsius.

15. The silver halide photographic element of claim 1, wherein the carrier comprises a thermoplastic polymer selected from the group consisting of polyolefins, polyesters, and ethylene-vinyl acetate copolymers and which melts in the range of from about 100 to about 180 degrees Celsius.

16. The silver halide photographic element of claim 1, wherein the carrier comprises a thermoplastic polymer selected from the group consisting of polyolefins, polyesters, and ethylene-vinyl acetate copolymers, ethylene-methacrylic acid copolymers, and ethylene-acrylic acid copolymers and which melts in the range of from about 100 to about 180 degrees Celsius.

17. The silver halide photographic element of claim 1, wherein the carrier further contains gelatin which is present in such an amount that it does not adversely affect transferring and adhering of said carrier onto said receptor element.

18. A silver halide photographic element, wherein the carrier further contains gelatin which is present in such an amount that it does not adversely affect transferring and adhering of said carrier onto said receptor element.

19. The silver halide photographic element of claim 10, wherein the carrier further contains gelatin.

20. The silver halide photographic element of claim 7, wherein the carrier further contains gelatin.

21. A silver halide photographic element, which comprises:

a support having a front and rear surface, and at least one silver halide light sensitive emulsion layer consisting essentially of light sensitive silver halide grains on said front surface of the support, with the proviso that the silver halide grains are non-organic silver salts, and with the proviso that said emulsion layer does not contain a dye donating substance other than a color coupler, wherein the silver halide grains are dispersed in or mixed with a carrier having a melting point of at least 100° C. and which is capable of transferring and adhering developed image and non-image areas from said front surface of said support after said silver halide photographic element is image-wise exposed, developed to form an image, and upon the application of heat energy to the rear surface of the support, said carrier strips from said front surface of the support by liquefying and releasing from said support when heated, said liquefied carrier providing adherence to a receptor element by flowing onto said receptor element and solidifying thereon, said adherence does not require an external surface adhesive layer and occurs in an area at least coextensive with the area of said silver halide grains and wherein said carrier is substantially photographically inert and acts only as a binding agent, except that it is capable of melting, transferring and adhering upon the application of heat.

22. The silver halide photographic element of claim 10, wherein the silver halide light sensitive emulsion layer is a light sensitive photographic layer in a black and white film or paper photosensitive material.

23. The silver halide photographic element of claim 10, wherein the silver halide light sensitive emulsion layer is a color light sensitive photographic layer in color negative film, color reversal film, color reversal paper, color positive film or color print paper.

* * * * *